US006105544A

United States Patent [19]

Auchter et al.

[11] Patent Number: 6,105,544

[45] Date of Patent: Aug. 22, 2000

[54] DEVICE FOR ALTERING THE OPENING AND CLOSING TIMES OF GAS-EXCHANGE VALVES OF AN INTERNAL-COMBUSTION ENGINE

[75] Inventors: Jochen Auchter, Aurachtal; Mike Kohrs, Wilthen; Andreas Strauss, Herzogenaurach, all of Germany

[73] Assignee: INA Wälzlager Schaeffler oHG, Herzogenaurach, Germany

[21] Appl. No.: 09/230,471

[22] PCT Filed: Apr. 19, 1997

[86] PCT No.: PCT/EP97/01981

§ 371 Date: Jan. 26, 1999

§ 102(e) Date: Jan. 26, 1999

[87] PCT Pub. No.: WO98/04811

PCT Pub. Date: Feb. 5, 1998

[30] Foreign Application Priority Data

Jul. 30, 1996 [DE] Germany ..... 196 30 662

[51] Int. Cl.[7] ..... F01L 1/344

[52] U.S. Cl. ..... 123/90.17; 123/90.31; 74/568 R; 464/2; 464/161

[58] Field of Search ..... 123/90.15, 90.17, 123/90.31; 74/568 R; 464/1, 2, 160, 161

[56] References Cited

U.S. PATENT DOCUMENTS

| | | | |
|---|---|---|---|
| 5,558,053 | 9/1996 | Tortul | 123/90.17 |
| 5,823,152 | 10/1998 | Ushida | 123/90.17 |

FOREIGN PATENT DOCUMENTS

| | | |
|---|---|---|
| 0 438 720 | 7/1991 | European Pat. Off. . |
| 04 140 407 | 5/1992 | Japan . |
| 05 018 216 | 1/1993 | Japan . |

*Primary Examiner*—Weilun Lo
*Attorney, Agent, or Firm*—Henry M. Feiereisen

[57] ABSTRACT

An apparatus (1) for changing the opening and closing times of gas exchange valves of an internal combustion engine has intercommunicating slide and freewheel means (15, 20). By means of these elements (15, 20), immediately upon starting the internal combustion engine, and adjusting piston (7) of the apparatus (1) is moved into its desired starting position and/or held there long enough for the apparatus (1) to be filled sufficiently with hydraulic fluid again. During the hydraulic-fluid-free state, the adjusting piston (7) is at the same time largely prevented from making any undesired oscillations.

12 Claims, 3 Drawing Sheets

DEVICE FOR ALTERING THE OPENING AND CLOSING TIMES OF GAS-EXCHANGE VALVES OF AN INTERNAL-COMBUSTION ENGINE

FIELD OF THE INVENTION

The invention relates to an apparatus for changing the opening and closing times of gas exchange valves of an internal combustion engine.

BACKGROUND OF THE INVENTION

An apparatus of this type is known from German Pat. No. DE-PS 29 09 803. After start of the internal combustion engine, the apparatus of this type has the problem that the respective adjusting piston travels at high speed into a maximum adjustment position and repeatedly impacts there at significant generation of noise. The reason for this is the fact that after shutdown of the internal combustion engine, hydraulic fluid residing in the apparatus gradually escapes from there so that the adjusting piston is no longer sufficiently supported, whereby, normally, a certain residual volume of hydraulic fluid is retained. As a consequence of the irregular rotation of the camshaft, the adjusting piston is shifted, after re-starting the internal combustion engine, into an end position under the mentioned significant noise development, because the adjusting piston is no longer hydraulically supported. This condition is observed during the period between ignition of the internal combustion engine and charging of the pressure compartments, i.e. few seconds after start of the engine.

SUMMARY OF THE INVENTION

It is thus an object of the invention, to provide an apparatus of the afore-mentioned type, obviating the pointed out drawbacks and in particular eliminating with simple means, i.e. with little constructive means, the described rattling at start and an oscillation of the angle of adjustment between camshaft and crankshaft, while creating at the same time a possibility for displacement of the apparatus into its starting position even when the adjusting piston is no longer hydraulically supported.

SUMMARY OF THE INVENTION

This object is attained in accordance with the invention by providing at least one locking means which, on the one hand, substantially bars the undesired adjusting direction when the pressure of hydraulic fluid in the respective pressure compartment falls below a required level for realizing a displacement of the adjusting piston into the desired preferred position, and, on the other hand, realizes a displacement into the preferred position via an auxiliary energy such as the component of the varying moments of the camshaft, acting in this direction.

Through the provision of locking means according to the invention a form-fitting connection between drive element and driven element of the apparatus is realized while the apparatus is largely in a hydraulic-fluid-free state. Thus, disadvantageous rattling noises encountered in the state of art as a consequence of high-frequency impacts of the adjusting piston in its one end position can thus be eliminated. On the other hand, the invention proposes that, in the event the adjusting piston does not occupy its desired starting position before re-ignition of the internal combustion engine, the adjusting piston is brought into this starting position via an auxiliary energy, such as the occurring varying moments of the camshaft. At the same time, a shift of the adjusting piston into its undesired starting position is substantially prevented by the invention.

Although immediately before shutdown of the internal combustion engine, the adjusting piston should be brought tentatively into its desired starting position through hydraulic fluid acting on the respective pressure compartment, there are, however, operational conditions of the internal combustion engine conceivable during which this state cannot be realized. For example, this would be the case when the internal combustion engine is merely operated over an extremely short period or inadvertently shuts down ("stalls"). The locking means according to the invention, for example formed as freewheel means or step-like or saw-tooth-like locking mechanism, thus preventing immediately after operating the internal combustion engine a shift of the adjusting piston into its undesired impact position. At the same time, the component of the varying moments of the camshaft, acting in the desired impact direction, is exploited to realize the advantageous starting position of the adjusting piston, as described above. The adjusting piston should thereby be held in the starting position for so long until the respective pressure compartments are filled sufficiently with hydraulic fluid to thereby realize a hydraulic support of the adjusting piston.

The preferred position in which the adjusting piston should be brought by the means according to the invention, even at insufficient hydraulic support immediately at start of the internal combustion engine, is constituted by its starting position. In the event, this apparatus is positioned, for example, at an intake camshaft, the adjusting piston should have occupied its "late" impact position for the starting position of the internal combustion engine, which position realizes a slight valve overlap with thus slight residual gas fraction in the cylinder. On the other hand, adjusting apparatuses on the exhaust end should effect in the starting position an early opening and closing of the respective gas exchange valve. The position in which the adjusting piston can be held by the means according to the invention may conceivably also be one of its intermediate positions between its end positions.

According to a suitable further development of the invention, it is proposed to provide the locking means in the form of intercommunicating slide and freewheel means, with a slide being positioned in one of the pressure compartments and shiftable by spring force in locking direction. This slide is, for example, connected in fixed rotative engagement to the driven unit via a longitudinal guide. Thus, when no hydraulic fluid pressure is present, the slide is shifted, in a simple manner, by the force of its compression spring and forms the locking means in conjunction with freewheel means which advantageously extend from the driving unit. However, it is also provided to secure the slide with its longitudinal guide to the driving means and to position the freewheel means on the output end.

It is also proposed, to provide the slide in the form of a concentric ring arranged within the drive unit. In this context, it is also conceivable to provide one or more slides in the form of satellites and arranged adjacent to the respective pressure compartment. Instead of using the compression spring for shifting the slide, other auxiliary energies may be utilized. It is only important to realize, during start of the engine and lacking hydraulic fluid pressure, the desired locking of the adjusting piston or its advance into the desired preferred position, as targeted by the invention.

According to a further feature of the invention, it is proposed to form the freewheel means selectively as sprag-type freewheel mechanism (with rollers or balls as clamping elements) and step-like or saw-tooth-like locking mechanism. Advantageously, the slide has a recess on the pressure compartment end to form an inner ring of the freewheel. When using the step-like or saw-tooth-like locking mechanism, it is in particular of advantage to effect a hundred percent form-fitting impact of the adjusting piston in its undesired adjusting position so that this adjusting movement is completely prevented during the desired locking action.

In order for the adjusting piston to realize in a simple manner a shift into its momentary desired preferred position, while exploiting the varying moments of the camshaft, the step sections of the locking mechanism must have a smaller length than a relative movement between drive unit and driven unit as a consequence of oscillation of the adjusting piston.

Finally, it is proposed to provide the axial guide for the slide in the form of conventional recess and groove configuration. However, the guide may also be provided as a gear profile such as a straight gearing or a tongue and groove mechanism or the like.

BRIEF DESCRIPTION OF THE DRAWING

The invention is suitably illustrated in the drawing, in which.

DETAILED DESCRIPTION OF THE DRAWING

Figure 1:
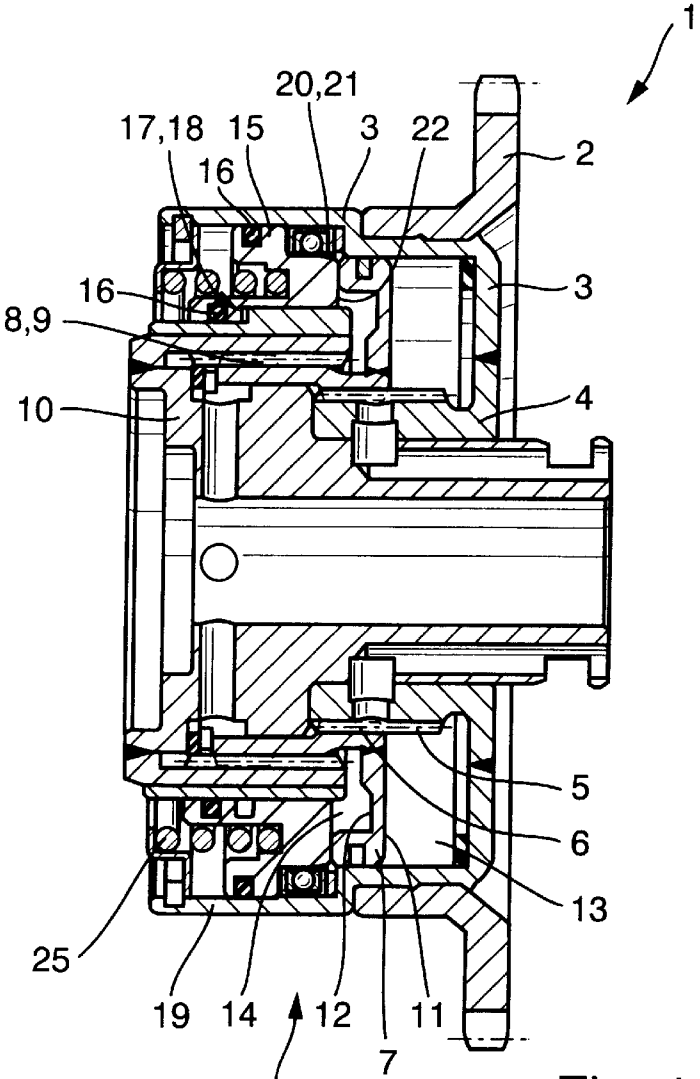

FIG. 1 shows an apparatus 1 for changing the opening and closing times of gas exchange valves of an internal combustion engine. The apparatus 1 includes a drive wheel 2 which is acted upon by traction means not shown in more detail. The drive wheel 2 is connected to a drive unit 3. The drive unit 3 includes an axial prolongation 4 with external oblique teeth 5. In mesh with these teeth 5 is an inner, toothed section 6 of an adjusting piston 7. The adjusting piston 7 in turn includes an external and obliquely toothed section 8 which is in mesh with inner teeth 9 of an driven unit 10 which is in fixed rotative engagement with a not shown camshaft.

Moreover, the adjusting piston 7 has end faces 11, 12 which demarcate pressure compartments 13, 14 for hydraulic fluid. Supply of hydraulic fluid into one of the pressure compartments 13 or 14 effects an axial displacement of the adjusting piston 7 and thus a relative rotation of the drive wheel 2 with respect to the not shown camshaft.

It is necessary to hold the adjusting piston in its preferred position long enough upon start of the internal combustion engine until the apparatus 1 is filled sufficiently with hydraulic fluid again. This preferred position is, in this case, one of its axial impact positions, for example, the one shown in FIG. 1, whereby the driven unit 10 is enclosed by an annular slide 15. This slide 15 is sealed radially to the outside and to the inside against the adjoining structural components 3, 10 by sealing rings 16. Furthermore, the slide 15 is secured in fixed rotative engagement with but movably supported for axial displacement relative to the driven unit 10. As the shown in the upper half of FIG. 1, an axial guide 17 is provided in the form of a recess and groove configuration 18. Moreover, a freewheel means 20, such as a sprag-type freewheel mechanism 21, is positioned on a housing inner surface area 19 of the drive unit 3. On the side of the pressure compartment 14, an end face 22 of the slide 15 is formed with a diameter reduction 23 (cf. FIG. 2) towards the outer surface area 24 of the slide 15. At the same time, the slide 15 is resiliently supported in direction towards the pressure compartment 14 by the force of a spring member 25, such as a compression spring, concentrically surrounding the driven unit 10.

After shutdown of the internal combustion engine, the pressure compartments 13, 14 run, as described in more detail in the introductory part of the specification, substantially empty of hydraulic fluid. Thus, the adjusting piston 7 is no longer sufficiently hydraulically supported. As these facts are known per se, an optimum starting position of the apparatus 1 is therefore attempted to be realized by moving the adjusting piston 7 into its desired starting position immediately upon shutdown of the internal combustion engine. Typically, this is realized by filling one of the pressure compartments 13 or 14 with hydraulic fluid immediately upon shutdown of the internal combustion engine, so that the adjusting piston 7 is moved tentatively into its preferred position. Coupling means hold the adjusting piston 7 long enough there until a sufficiently large hydraulic fluid pressure has built up in the pressure compartments 13, 14 after re-start of the internal combustion engine. Operational conditions of the apparatus 1 are, however, also conceivable which make it impossible to move the adjusting piston 7 into its preferred position immediately before shutdown of the internal combustion engine. This would then cause the adjusting piston 7, at start of the internal combustion engine, to oscillate in its adjustment range, as known per se by the artisan, and possibly to impact on its retarded stop at emission of significant noise. The invention described herein solves this problem in a simple manner.

When the pressure of hydraulic fluid fades in the pressure compartments 13, 14, the slide 15 is shifted into direction towards the pressure compartment 14 by the force of its spring member 25, thereby seizing from below with its diameter reduction 23, as shown in FIG. 1, the sprag-type freewheel mechanism 21 and forming with the latter a locking means 26. In the event of occupying any of its adjustment positions after shutdown of the internal combustion engine, the adjusting piston 7 after re-starting is prevented from oscillating in the undesired adjustment direction by the freewheel means 20 on the one hand, and the freewheel means 20 permit in conjunction with the slide 15 a shift of the adjusting piston 7 into its desired starting position, on the other hand, while exploiting the mentioned varying moments of the camshaft.

Figure 2:
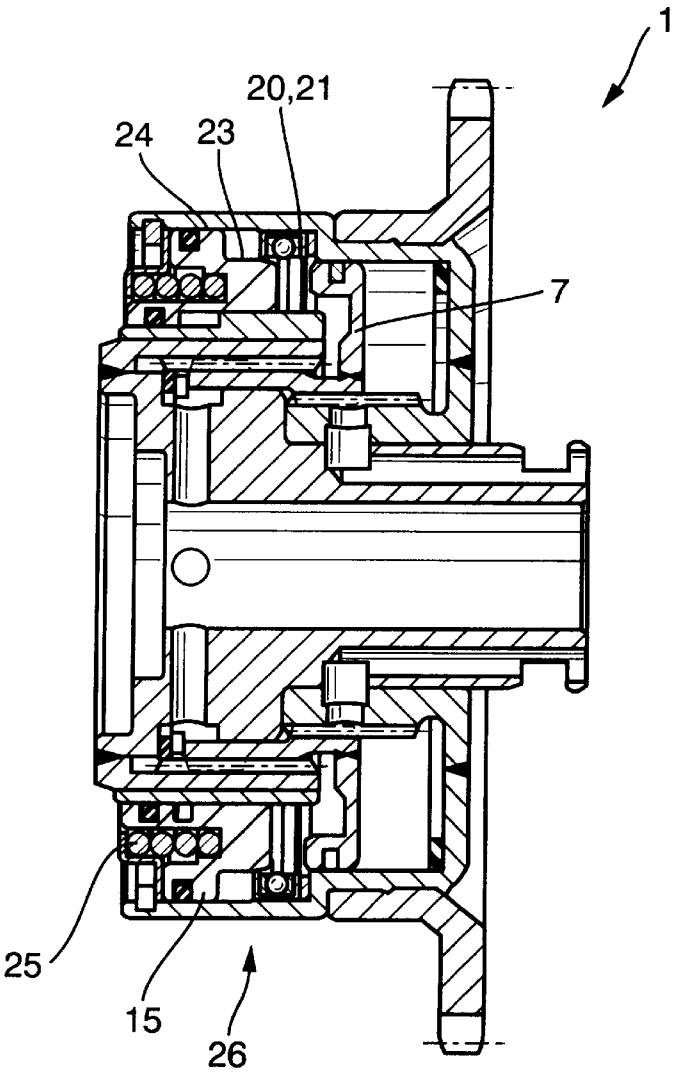
FIGS. 1, 2 show a longitudinal section through an apparatus, in which the locking means is formed by a sprag-type freewheel mechanism.

FIG. 2 shows an apparatus similar to the one illustrated in FIG. 1, however the locking means 26 are out of operation here. It can be seen that the slide 15 is shifted in its pressure compartment distant position in opposition to the force of its spring member 25. This state is realized when the pressure compartments 13, 14 are filled sufficiently with hydraulic fluid again, and the applied pressure of the hydraulic fluid results in an axial displacement of the slide 15 axially towards the outside. Thus, the operational stage of the apparatus 1 shown in FIG. 2 represents the stage in which the fixed rotative engagement between drive wheel 2 and driven unit 10 is suspended.

Figure 4:
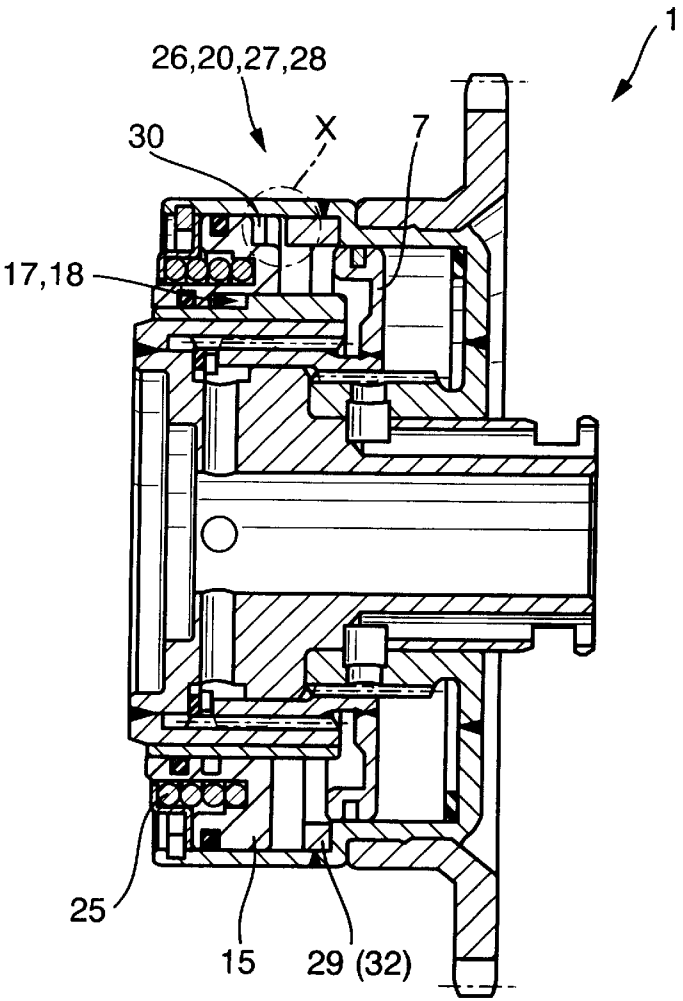
FIGS. 3, 4 show an apparatus similar to the previous one, however with a locking mechanism as freewheel means
Figure 3:
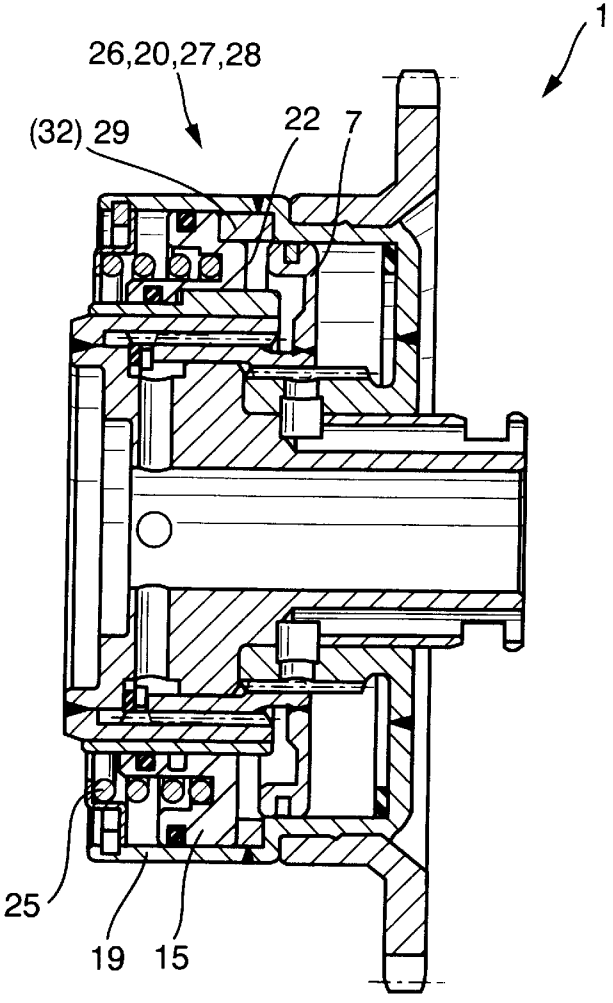

The principal configuration of the apparatus 1 shown in FIGS. 3 and 4 is substantially identical to the preceding configuration. The locking means 26 is however, formed as a step-like or saw-tooth-like locking mechanism 27 or 28, as shown in more detail in FIGS. 5 and 6, with a separate structural component 29, such is a ring, being positioned on the inner surface area 19 of the drive unit 3. At the same time, the slide 15 is provided in the area of its end face 22 with the locking mechanism 27 or 28. The structural component 29 acts here as ratchet 32, with the adjusting piston 7 again being shown in its locked position in FIG. 3. Steps 30 or teeth 31 (see FIGS. 5, 6) thus prevent a rotation of the drive wheel 2 relative to the driven unit 10 in the undesired direction, and on the other hand, the adjusting piston 7 is drawn again to its preferred direction under exploitation of a component of the varying moments of camshaft, until realizing indirectly on a last step 30 or a last tooth 31 an end stop by which the preferred starting position of the adjusting piston 7 is defined.

FIG. 4 also illustrates the state of the apparatus 1 in which its pressure compartments 13, 14 are again filled sufficiently with hydraulic fluid, and the slide 15 is moved by hydraulic fluid pressure from its coupling position.

Figure 5:
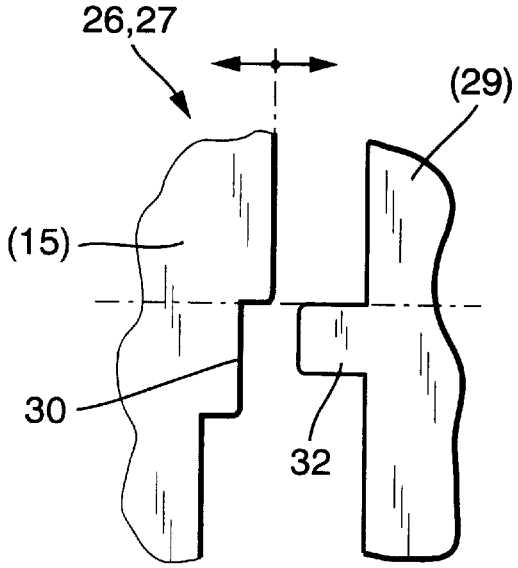
FIGS. 5, 6 show an enlarged and simplified side view of the detail X according to FIG. 4.
Figure 6:
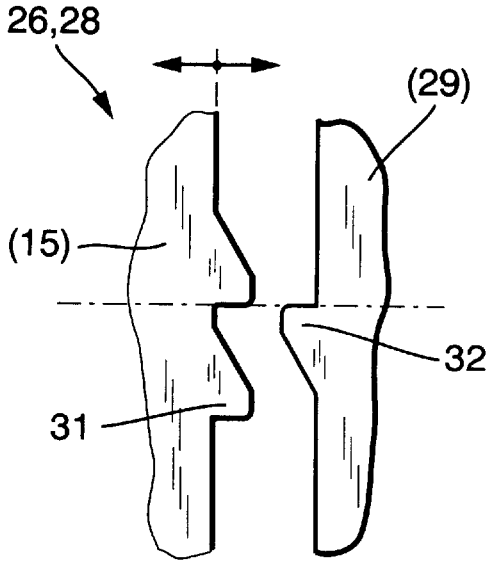

FIGS. 5, 6 show to the artisan in more detail that, for example, the structural component 29 may include the ratchet 32 for cooperation with the respective step 30 or the tooth 31 of the slide 15.

What is claimed is:

1. Apparatus for changing the opening and closing times of gas exchange valves of an internal combustion engine, comprising:

a drive unit in driving relationship with a crankshaft via a tension means, said driving unit including a drive wheel and a housing;

a driven unit in fixed rotative engagement with an intake or exhaust camshaft;

an adjusting piston for adjusting a relative rotation between the crankshaft and the camshaft, said adjusting piston being capable of reciprocating in the housing between two end positions by means of a hydraulic medium for defining two pressure compartments, said adjusting piston having two axially-spaced sections in the form of opposing oblique teeth, with one of the sections interacting with complementary teeth of the drive unit, and with the other one of the sections interacting with complementary teeth of the driven unit; and a locking means for substantially barring a displacement of the adjusting piston into an undesired adjusting direction when the pressure of hydraulic fluid in the respective one of the pressure compartments falls below a required level for realizing a displacement of the adjusting piston, and for permitting a displacement of the adjusting piston into a preferred position via an auxiliary energy.

2. The apparatus of claim 1 wherein the auxiliary energy for displacement of the adjusting piston into the preferred position is a component of varying moments of the camshaft, acting in the direction of the desired position of the adjusting piston.

3. The apparatus of claim 1 wherein the preferred position is an optimized starting position of the adjusting piston which starting position is determined by one of its maximal impact positions in the apparatus when restarting the internal combustion engine.

4. The apparatus of claim 1 wherein the locking means includes a slide and a freewheel interacting with one another for positively connecting the drive unit and the driven unit when essentially no hydraulic pressure is applied, said freewheel forming part of the slide and being selectively mounted to one of the drive unit and driven unit, said slide being positioned in one of the pressure compartments or in a region adjacent to one the pressure compartments, and selectively cooperating with the drive unit or the driven unit via an axial guide, said slide being shiftable in a direction toward the camshaft for interaction with the freewheel when the pressure of the hydraulic fluid drops below a required level for realizing a displacement of the adjusting piston.

5. The apparatus of claim 4 wherein the slide is formed by a ring positioned radially inside the drive unit and enclosing the driven unit, said ring being acted upon in an engagement direction by the force of a spring member.

6. The apparatus of claim 5 wherein the spring member is a compression spring.

7. The apparatus of claim 5, and further comprising sealing means for sealing the slide radially to the outside and to the inside with respect to the drive unit and the driven unit.

8. The apparatus of claim 7 wherein the sealing means includes piston seal rings.

9. The apparatus of claim 4 wherein the freewheel is formed as sprag-type freewheel mechanism which is mounted to an inner surface area of the housing of the drive unit, said slide having a camshaft-confronting end face and an outer surface area, said slide being formed in the area of the end face with a diameter reduction of the outer surface area for forming an inner ring for the freewheel when the slide is in engagement.

10. The apparatus of claim 4 wherein the freewheel includes a step-like or saw-tooth-like locking mechanism and a complementary ratchet in axially opposing disposition at one of a camshaft-confronting end face of the slide, a partial section of an inner surface area of the housing of the drive unit, and a component mounted separately to the partial section.

11. The apparatus of claim 10 wherein the locking mechanism has profiled sections, each of the profiled sections having a length which in circumferential direction is smaller than a relative movement between drive unit and driven unit caused by oscillation of the adjustment piston as a consequence of varying moments of the camshaft.

12. The apparatus of claim 4 wherein the axial guide is formed as recess and groove configuration.

* * * * *